United States Patent [19]

Bisson

[11] Patent Number: 4,736,565

[45] Date of Patent: Apr. 12, 1988

[54] RETAINING FASTENER FOR PANELING

[76] Inventor: Gaétan Bisson, 111, de la Colline St. County of Lévis, Canada, G0S 2W0

[21] Appl. No.: 21,131

[22] Filed: Mar. 3, 1987

[51] Int. Cl.[4] ..... E04C 2/30

[52] U.S. Cl. ..... 52/526; 52/519; 52/522

[58] Field of Search ..... 52/519, 522, 526, 478

[56] References Cited

U.S. PATENT DOCUMENTS

| | | | |
|---|---|---|---|
| 2,739,676 | 3/1956 | Tomita . | |
| 3,507,079 | 4/1970 | George | 52/519 X |
| 3,969,866 | 7/1976 | Kyne | 52/522 X |
| 4,054,012 | 10/1977 | Paradisi et al. | 52/519 X |
| 4,272,576 | 6/1981 | Britson | 52/519 X |
| 4,648,218 | 3/1987 | Butzen | 52/526 X |

FOREIGN PATENT DOCUMENTS

| | | | |
|---|---|---|---|
| 492358 | 4/1953 | Canada | 52/519 |
| 1011076 | 5/1977 | Canada . | |
| 1171825 | 9/1984 | Canada . | |

*Primary Examiner*—J. Karl Bell

[57] ABSTRACT

In wall siding panels having vertical edge portions adapted to overlap, fasteners prevent the vertical joint so formed from bending or bulging outwardly. The panels have declinations and flat lengthwise, horizontal shoulders joining the declinations to resemble clapboard finishing. A female aperture is formed in each shoulder of one panel adjacent its vertical edge portion, and a male projection is formed in each shoulder of the other panel adjacent its vertical edge portion. When a pair of two longitudinally-spaced, oppositely-directed projections are provided, which are selectively used so as to permit panel overlapping in any order edge portions are overlapped, each projection elements have identical profiles.

9 Claims, 5 Drawing Sheets

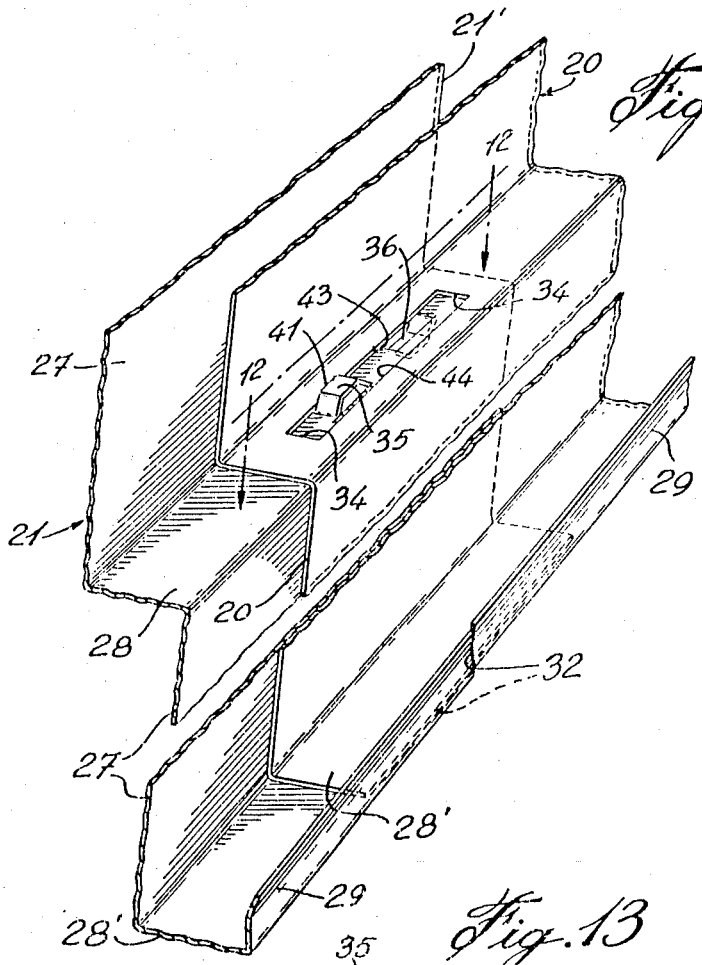
Fig. 11
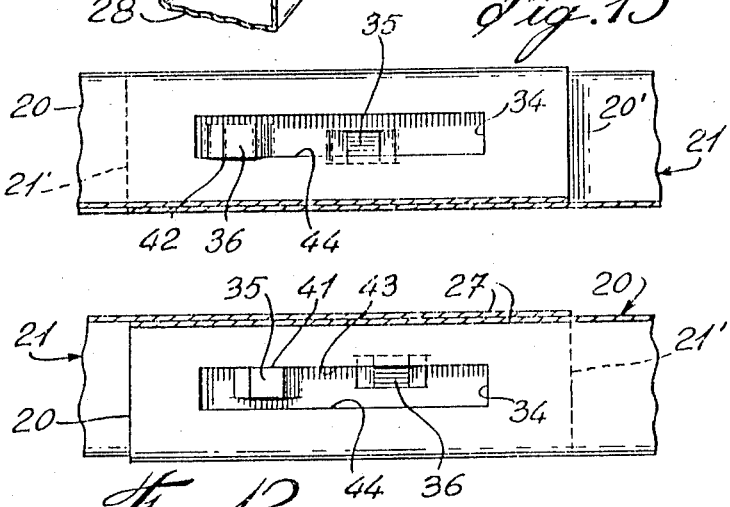
Fig. 12
Fig. 13
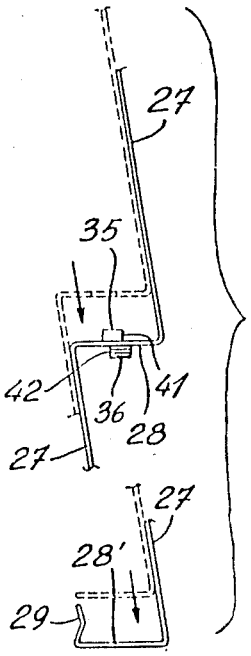
Fig. 14

RETAINING FASTENER FOR PANELING

FIELD OF THE INVENTION

The present invention relates to wall panels imitating clapboard.

BACKGROUND OF THE INVENTION

Houses and other buildings frequently have exterior clapboard walls for a desired aesthetic appearance, among other means. Since clapboard walls are made of wood planks, they must be periodically painted or replaced. To avoid such work and expense, it has become common practice to provide exterior siding of the same profile as clapboard but actually made of a plurality of assembled metallic painted panels.

Till now, these panels have been of a maximum width not exceeding two declinations, a declination being a flat, outwardly, downwardly-inclined rigid strip or sheet-intended to resemble a clapboard. A building wall is conventionally several horizontal rows of panels, by covered by nailing or otherwise securing each panel of a row along its upper edge and overlapping the side edges of two adjacent panels. The panels cannot be more than two declinations wide, because the central joint portions of two adjacent panels would tend to separate and/or bulge outwardly, which is ineffective and unsightly. Thus, it is time-consuming and costly to install two-declination panels, because more material must be used and less wall area is covered per unit panel, and because more man-hours are required.

OBJECTS OF THE INVENTION

In view of the above, it is a prime object of the present invention to provide retaining fasteners for clapboard-imitation panels which obviates the above-mentioned problems in that they make possible the use of siding panels having three, four or even more declinations each.

It is another object of the present invention to provide siding panels of the character described, which may be easily formed with the fasteners during manufacture.

It is an important object of the present invention to provide fastening means at each shoulder of the panel sidings, which permit overlapping of the adjacent panels in a horizontal row to be made in any order.

Another object of the invention is to provide a fastening means of the character described, which firmly interlocks each intermediate shoulder of adjacent panels, and yet which allows longitudinal play between the panels for easier installation of the same.

Another object of the invention is to provide a neat appearance of the joint formed at the two adjacent panels.

SUMMARY OF THE INVENTION

The above and other objects and advantages of the present invention are realized according to the embodiments of the invention, each comprising, for the purposes of description, two panels each having oppositely-facing, vertical side edge portions.

Both panels are formed with at least three downwardly- and slightly outwardly-extending declinations, each pair of adjacent declinations being separated by, and integrally formed with, a flat lengthwise horizontal shoulder.

Each panel is further formed with an upper attachment strip and a lower catch edge, as is known.

The first point of novelty of the invention resides in the following. Adjacent the side edge of one panel, each shoulder is formed with a projection which extends away from the shoulder. Each projection has at least one frontwardly-facing edge terminating short of the adjacent declination. However, it is preferred that each projection be of a particular shape, as described below.

Adjacent the side edge of the other panel, each shoulder is formed with an aperture having a front edge and of a size sufficient to receive the projection of the first panel. The front edge of the aperture and the frontwardly-facing edge of the projection abut each other. Thus, when the two panel edge portions are overlapped, each projection and its corresponding aperture make a secure fastener which effectively prevents the vertical joint so formed from separating or bulging. Moreover, each fastener is practically invisible when the panels are assembled.

In order to facilitate the manufacture of siding panels provided with the fastener of the invention, each projection is preferably made by punching out the shoulder, so that the projection assumes the shape of an upwardly-frontwardly-curved semi-circle having a pair of lateral edges which merge upwardly centrally. The projection is secured to the shoulder at its rear edge. The punched-out projection may also project downwardly frontwardly, and in both forms there is left, of course, a perforation having the same length and transverse breadth as the projection.

The apertures of the other panel are preferably made in exactly the same fashion and are preferably slightly lengthwisely longer than the projections to facilitate the installation of the panels near a window frame, for example.

The second point of novelty of the invention is the following: for each projection extending towards the upper attachment strip, i.e. the top nailing edge, there is further included for each shoulder a second projection extending away from the top nailing edge and longitudinally spaced from the first-named projection along the shoulder. The aperture receives one or the other of the first-named projection and of the second projection, depending on whether the shoulder formed with the aperture overlies or underlies the shoulder formed with two projections.

In this latter embodiment, longitudinal play between the panels is now possible when interlocking the same at each intermediate shoulder. Moreover, the interfitting projections now substantially provide a proper locking and good face-to-face contact of the overlapping portions of the panels.

BRIEF DESCRIPTION OF THE DRAWINGS

The above will be fully understood by having referral to the embodiments of the invention, illustrated by way of the accompanying drawings, in which:

FIG. 11 is a perspective view looking downwardly from the back of the overlapped panels but showing an inverted overlapped position with respect to FIGS. 7 to 10, respectively;

FIG. 12 is a top plan sectional view, taken along line 12—12 of FIG. 11;

FIG. 13 is a bottom plan sectional view, taken along line 13—13 of FIG. 8; and

FIG. 14 is an exploded end elevation, at a smaller scale, of the panel provided with the projections in accordance with the third embodiment of the invention, and showing in dotted lines how the side edge portions of the adjacent panel provided with apertures at the shoulders, are fitted in overlapped position.

DETAILED DESCRIPTION OF PREFERRED EMBODIMENTS

Figure 1:
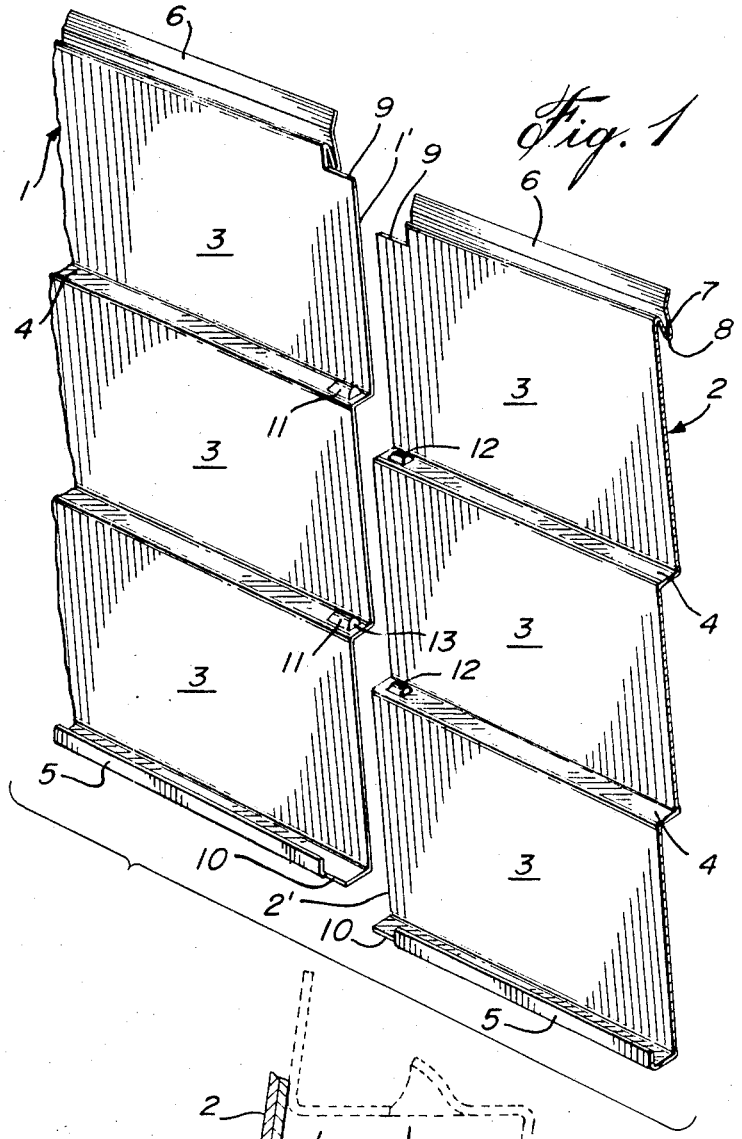
FIG. 1 is a rear perspective view of two panel sections provided with a first embodiment of the fastener means.

FIG. 1 shows two panel sections 1, 2, each having a mutually-facing vertical side edge 1', 2'. Panels 1, 2 are identical, having three declinations, each adjacent pair of declinations being joined by a flat lengthwise horizontal shoulder 4. Declinations 3 have a slight downward, outward slope to resemble clapboard finishing.

Each panel 1, 2 further has an upstanding catch flange 5 formed with the lowermost shoulder 4. The upper portion of each panel 1, 2 is formed with a lengthwise attachment strip or nailing edge 6, which merges with a crimped portion 7, the latter defining a lengthwise slot 8. Portion 7 forms a downwardly-extending flange and forwardly of the panel, and the slot 8 is downwardly opening.

In order to provide a close overlapping fit between panel sections 1 and 2, the vertical side edges 1', 2' are cut away at 9, 10, respectively, as shown.

The known assembly procedure consists of nailing, otherwise attaching, a panel 1 or 2 to the lower portion of a wall (not shown) at its upper attachment strip. Then catch flange 5 of another panel is inserted into slot 8, and this other panel is in turn nailed above the first panel, etc.

Covering a wall lengthwise consists of overlapping the side edge portions of two adjacent panels. The point of novelty of the invention is in providing a fastener to retain the vertical joint so formed. As shown, each shoulder 4, except the lowermost shoulder 4, is formed, adjacent the facing side edges 1', 2', with projections 11, 12, respectively, made by punching out the shoulders 4.

Figure 3:
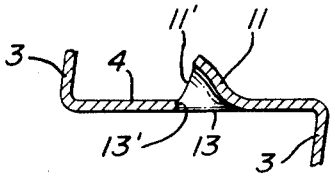
FIG. 3 is an enlarged sectional view of a panel shoulder formed with one element of the fastener means of FIG. 1.

Projections 11 may extend curvedly upwardly, as shown in FIG. 3, and have a pair of frontwardly-facing lateral edges 11' merging upwardly centrally in the approximate form of a semi-circle. Edges 11' terminate short of the proximate declination 3. The punching forms an aperture or perforation 13 under each projection 11, the latter being secured to each shoulder 4 at its rear edge. Aperture 13 has a front edge 13'.

Projections 11, as described, are adapted to be engaged by projections 12 through apertures 13 which constitute the female elements of the fasteners.

Projections 12 are formed in exactly the same manner and, thus, have the same shape as projections 11; but are of slightly smaller thickness to allow for sheet metal thickness in the assembled position of panels 1, 2. Projections 12 also have a pair of frontwardly-facing lateral edges 12', which merge upwardly centrally. As for projections 11, there is an aperture 14. Projections 12 constitute the male elements of the fasteners.

Figure 4:
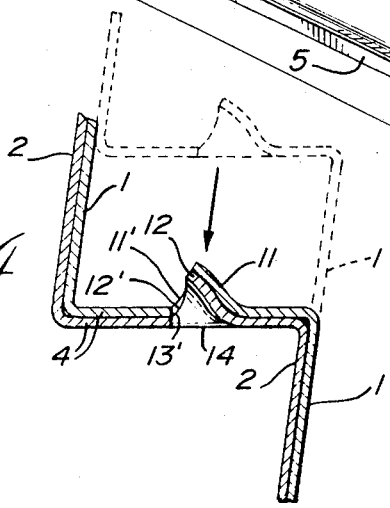
FIG. 4, shown on the first sheet of the drawings, is a cross-sectional view similar to that of FIG. 3, but additionally showing how a fastener locks together two overlapping panel shoulders.
Figure 2:
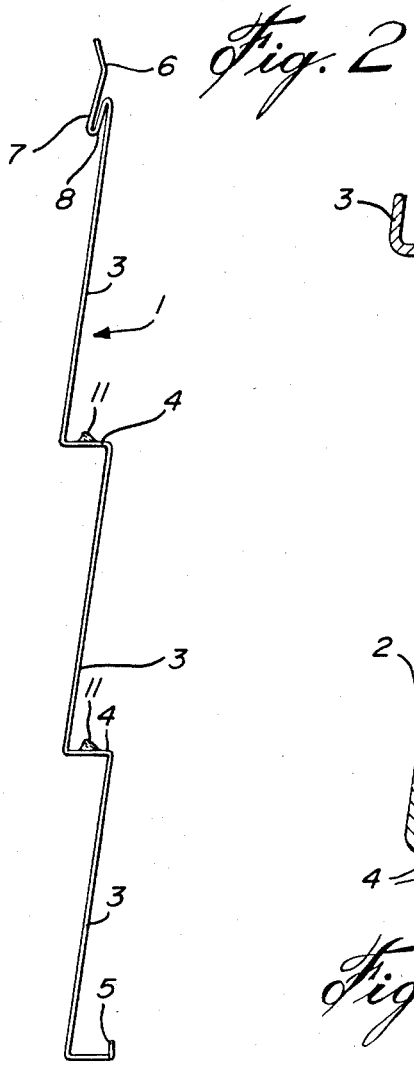
FIG. 2 is an end view of one of the panels of FIG. 1 provided with the first embodiment of the fastener means.

FIG. 4 illustrates how the fasteners secure the two panels together; each projection 12 lies flush with projection 11 and the front edge 13' of each aperture 13 abuts the two lateral edges 12' of projection 12, thereby preventing any transverse movement of one panel relative to the other.

Figure 5:
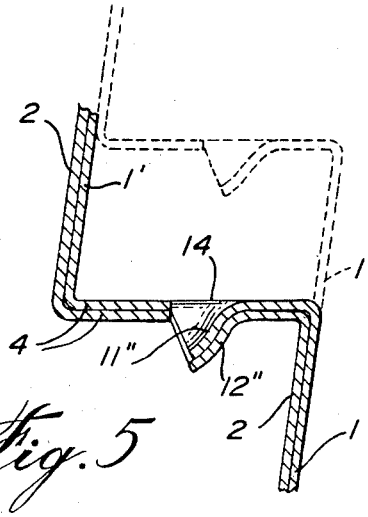
FIG. 5 is similar to FIG. 4 but showing a second embodiment of the fastener means.
Figure 6:
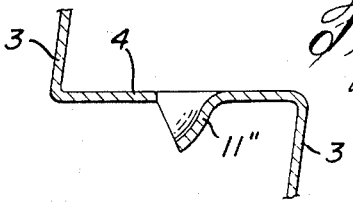
FIG. 6 is similar to FIG. 3 but showing the second embodiment of the fastener means.
Figure 7:
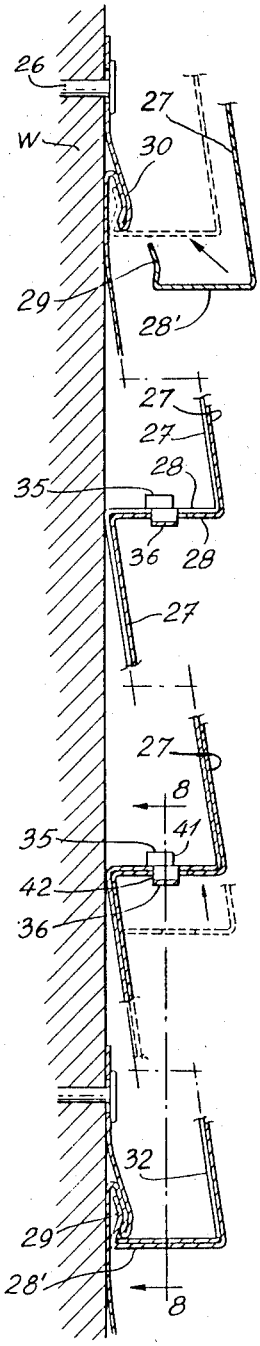
FIG. 7 is an exploded cross-section of the overlapped side edge portions of two wall siding panels, as attached to a wall in accordance with a third embodiment of the invention, and said section being taken along line 7—7 of FIG. 8.

In a second embodiment of the invention, FIGS. 5 and 6 show that projections 11 and 12 can extend downwardly instead of upwardly. In these figures, the projections of panels 1 and 2 are denoted 11'' and 12'', respectively.

However, with the above-disclosed embodiments of the invention, it was found that the overlapping of adjacent panels must be always in the same order. More specifically, panel 2 must be disposed in front of panel 1 in the overlapping position of the two panels. This would be true even if the projection 11 was absent with only the aperture 13' being provided in the shoulders of panel 1. Therefore, the panel siding installer must take care of overlapping the different panels in the right order.

Also, due to the shape of the projections 11 and 12, there is practically no longitudinal play possible between the panels when interlocking the same at each intermediate shoulder, and this requires special care in fitting the panels to the wall being covered.

It was also found that sometimes the inter-fitting projections fail to provide a proper locking and good face-to-face contact of the overlapping portions of the panels.

To correct these drawbacks, a third embodiment of the invention was devised, and is illustrated in FIGS. 7 to 14 of the drawings.

There are shown therein two siding panels 20 and 21, each having a top nailing edge portion 23, respectively, provided with spaced holes 25 and adapted to be nailed flat against the wall W to be covered by means of nails 26 inserted through holes 25.

Figure 8:
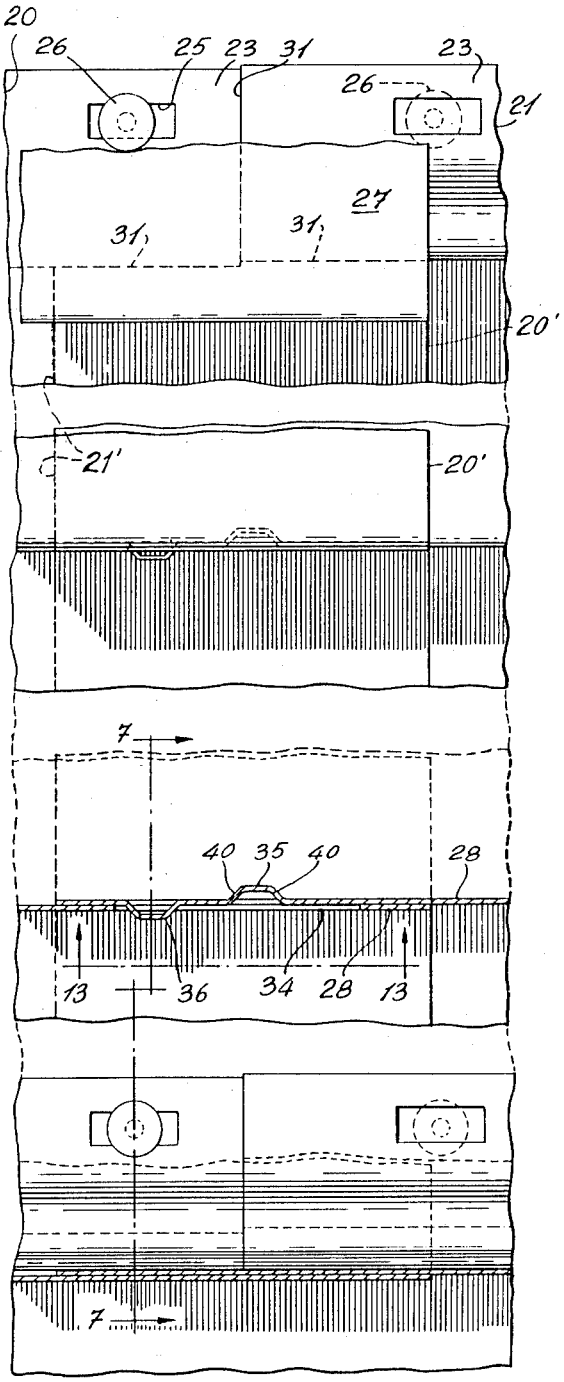
FIG. 8 is a sectional elevation looking towards the wall of the overlapped side edge portions of two adjacent panels in acordance with a third embodiment of the invention, and taken along line 8—8 of FIG. 7.

Panels 20, 21 are made of sheet metal painted on the outside and are of substantially uniform and equal thickness from one panel to the other. Each panel is formed to provide, below the top nailing edge portion 23, three declinations 27, each adjacent pair of the declinations being separated by a flat lengthwise horizontal shoulder 28; the lowermost shoulder 28' is provided at its back edge with an upstanding catch flange 29 adapted to engage with a snap action into the slot 30 formed by a bent part of the sheet material making the panel and extending horizontally just below the top nailing edge portion 23. Thus, when a lower horizontal row of panels, disposed side by side, have been completed, the next upper row of panels may be fixed with the catch flanges 29 of the panels of this next upper row engaging the slots 30 of the panels of the other lower row. The panels 20, 21 of the same row are overlapped at their adjacent side edge portions. In FIG. 8, panel 20 is at the front, the side edge 20' exposed, and panel 21 at the back, its side edge 21' hidden by front panel 20. For proper overlapping, panels 20, 21 are cut away at their nailing edge 23 down past the fold forming the slot 30, as shown at 31, and they are also cut away in the lower catch flange 29, as shown at 32 (see FIG. 11).

The above-defined construction is conventional.

In accordance with the invention, each intermediate shoulder 28, excluding the lowermost shoulder 28' is provided adjacent one side edge of the panel 20 or 21 with a rectangular aperture 34 and adjacent its opposite side edge with a pair of projections 35, 36, either one of which is adapted to engage the aperture 34 of an adjacent panel of the same row and in accordance with the order of overlapping of the adjacent side edge portions of any two panels.

Opening 34 is of rectangular shape and its axis is substantially parallel to the declination 27, as clearly shown in FIG. 11, 12 or 13. Projection 35 extends upwardly from the shoulder 28, that is in the direction of the nailing edge portion 23. Projection 36, on the contrary, extends downwardly from shoulder 28, that is in a direction away from nailing edge portion 23. Each projection 35, 36 consists of a punched-out part, of rectangular shape, when seen in plan view, being integrally connected to the shoulder 28 at its opposite ends. Each projection 35, 36 is dome-shaped when seen in side elevation, providing inclined surfaces 40 at either end. Each projection 35, 36 has a front edge 41 and a rear edge 42, respectively, relative to the adjacent upwardly-extending declination 27. These edges 41, 42 extend substantially parallel to the declination 27 and each one is engageable with the front and rear edges 43, 44, respectively, of the aperture 34.

The width of the aperture 34 is slightly more than the width of either one of projections 35, 36, and the length of aperture 34 is slightly greater than the distance between the outer ends of the pair of projections 35, 36, as clearly shown in FIG. 11, 12 or 13.

Referring to FIGS. 12 and 13, it is also clearly seen that the two projections 35 and 36 are not in longitudinal alignment along the shoulder 28. More specifically, the spacing of the front edge 41 of the upwardly-extending projection 35, from the adjacent upwardly-extending declination 27, is greater than the spacing of the front edge of the downwardly-extending projection 36, from the adjacent declination 27, by an amount about equal to twice the thickness of the sheet material constituting the panels 20, 21.

Because of the pair of the oppositely-directed projections 35, 36 at each intermediate shoulder 28, the adjacent side edge portions of two panels disposed side by side in a row, can be overlapped in any order, that is with declinations 27 of one panel overlapping the outer front face or the rear inner face of the declinations of the other panel and, consequently, the shoulders 28 of one panel can be over or under the shoulders of the adjacent panel.

Referring to FIGS. 7 to 10 and 13 it is seen that the shoulder side edge portion provided with rectangular aperture 34 lies under the shoulder 28 of the adjacent panel provided with the projections 35, 36. Therefore, it is the projection 36 which engages within the aperture 34 and locks the two overlapping shoulders in this locking position. As shown in FIG. 13, the rear edge 42 of the projection 36 frictionally engages the rear edge 44 of the aperture 34, so as to retain the adjacent overlapping portions of the declinations 27 of the two panels flat one against the other. In this overlapped condition, the upwardly-extending projection 35 is out of longitudinal register with the aperture 34, but extends away therefrom.

In FIGS. 11 and 12, it is seen that the overlapping is reversed, that is the shoulder provided with aperture 34 lies on top of the shoulder provided with the projections 35, 36. Therefore, it is the projection 35 which extends within the opening 34, with its front edge 41 in frictional contact with the front edge 43 of the aperture 34. From one overlapped position to the other, there is a change of twice the thickness of the sheet material constituting the panel in the relative position of the projections 35, 36 with respect to the aperture 34. Due to the longitudinal misalignment of the two projections as above noted, in either overlapped condition, there is firm engagement of either projection within the opening and firm retaining of the declinations one against the other.

It is clear also that the two overlapped panels can be longitudinally shifted one with respect to the other, while remaining locked at their shoulders 28. This facilitates installation of the panels in a row for proper fitting on the wall W.

Figure 9:
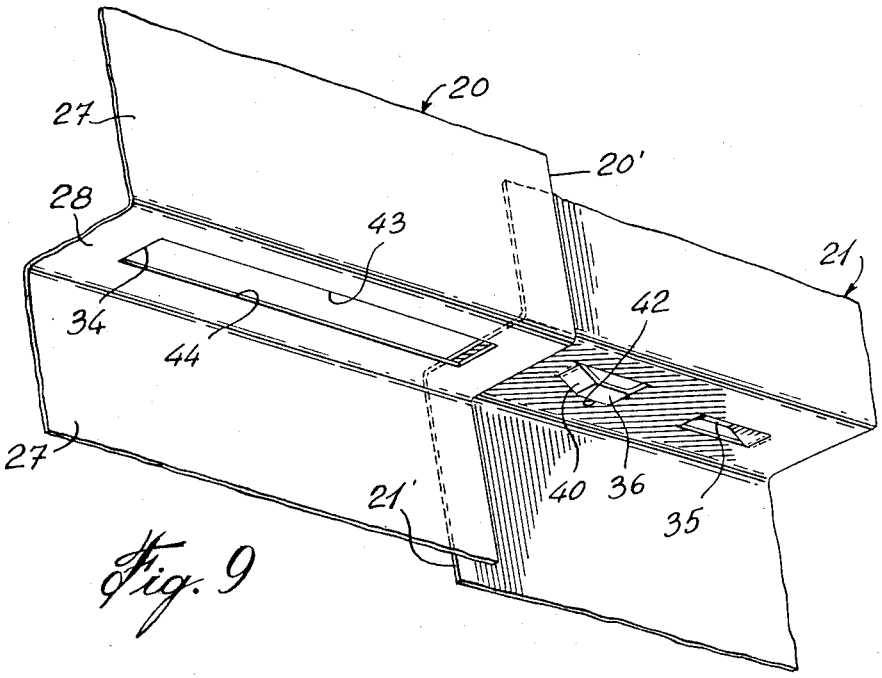
FIGS. 9 and 10 are enlarged perspective views looking upwardly at the shoulders of the adjacent side edge portions of panels in accordance with the third embodiment of the invention, and in the process of panel-overlapping and after the overlapping is completed, respectively.
Figure 10:
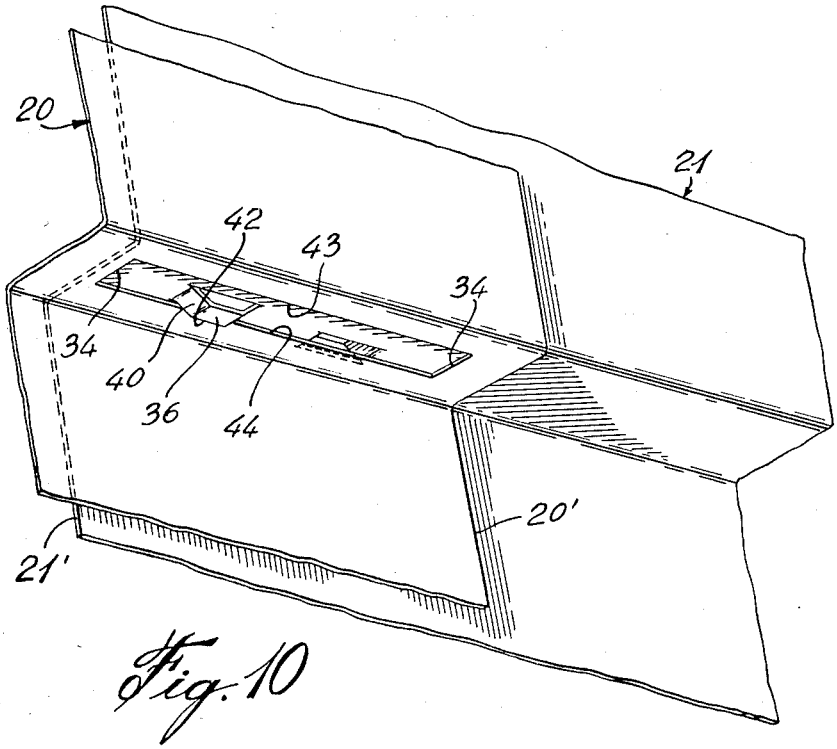

Overlapping is also facilitated because one panel can be simply overlapped and then longitudinally slid relative to the other panel, as shown in FIGS. 9 and 10. During this movement, the edge of the shoulder of one panel simply slides along the inclined end 40 of either one of projections 35, 36.

Because the front and rear edges 41 and 42 of the projections 35,36 lie in a plane substantially normal to the associated shoulder 28, firm interlocking of the overlapped shoulders is achieved.

Various modifications can be made to the above-described embodiments without departing from the spirit or scope of the invention. For example, the shape of the fastener may vary.

What I claim is:

1. Paneling for use as wall siding, comprising:

a plurality of similar panels disposed in at least two horizontal rows, each panel of substantially identical profile, each panel having a top nailing edge portion, a forwardly- and downwardly-disposed flange just below said nailing portion forming a downwardly-opening slot, at least three downwardly and slightly-outwardly extending horizontal declinations below said flange, each pair of adjacent declinations being joined by a flat lengthwise generally horizontal shoulder extending rearwardly from the bottom of the adjacent upper declinations, each panel forming at its lower edge an additional said shoulder terminated by an upstanding catch flange adapted to fit within the slot of a panel of an adjacent upper row, adjacent side edge portions of two adjacent first and second panels of one horizontal row overlapping each other, each shoulder of said first panel being formed with an aperture located at its side edge portion, each shoulder of said second panel being formed with a projection located at its side edge portion, the apertures and projections constituting inter-engageable male and female elements, respectively, which interlock the overlapping side edge portions of said first and second panels at each of said shoulders of said first and second panels.

2. Panelling as defined in claim 1, wherein each aperture and each projection has a front edge spaced rearwardly from the adjacent declination, the front edge of each projection engaging the front edge of the associated aperture to retain the overlapped side portions flat one against the other.

3. Panelling as defined in claim 2, wherein each projection is formed by a punched-out first part of said shoulder and each aperture is also formed by a punched-out second part, said first part conforming and mating with said second part.

4. Panelling as defined in claim 3, wherein said first and second parts extend towards said top nailing edge portion.

5. Panelling as defined in claim 3, wherein said first and second parts extend away from said top nailing edge portion.

6. Paneling for use as wall siding, comprising:

a plurality of similar panels disposed in at least two horizontal rows, each panel of substantially identical profile, each panel having a top nailing edge portion, a forwardly- and downwardly-disposed flange just below said nailing portion forming a downwardly-opening slot, at least three downwardly- and slightly-outwardly extending horizontal declinations below said flange, each pair of adjacent declinations being joined by a flat lengthwise generally horizontal shoulder extending rearwardly from the bottom of the adjacent upper declination, each panel forming at its lower edge an additional said shoulder terminated by an upstanding catch flange adapted to fit within the slot of a panel of an adjacent upper row, adjacent side edge portions of two adjacent first and second panels of one horizontal row overlapping each other, each shoulder of said first panel formed with an aperture located at its side edge portion, each shoulder of said second panel formed with a first and with a second projection located at its side edge portion, the apertures and first or second projections constituting inter-engageable male and female elements, respectively, which interlock the overlapping side edge portions of said first and second panels at each of said shoulders of said first and second panels, each said first projection extending towards said top nailing edge portion; each said second projection extending away from said top nailing edge portion and longitudinally spaced from said first projection along said shoulder, and the corresponding said aperture receives one of the other of said first and said second projections, depending on whether the shoulder formed with said aperture overlies the shoulder formed with said first and second projections.

7. Panelling as defined in claim 6, wherein each panel is made of sheet material of substantially equal and uniform thickness, said first projection and said second projection each having a front edge extending substantially normal to said shoulder and substantially parallel to and rearwardly from the adjacent declination thereof, and the spacing of the front edge of said first projection from said adjacent declination being greater than the spacing of the front edge of said second projection from the adjacent declination thereof by an amount equal to twice the thickness of said sheet material.

8. Panelling as defined in claim 7, wherein each said first projection and second projection is formed by a punched-out part of said shoulder, said punched-out part having a generally rectangular shape when seen in top plan view, integral with said shoulder at its two ends and having a dome-shape when seen in side elevation.

9. Panelling as defined in claim 8, wherein each said aperture has a length along said shoulder which is greater than the distance along said shoulder between the outermost ends of the pair of punched-out parts constituting said first and said second projection, and the width of said aperture is slightly greater than the width of either one of said punched-out parts.

* * * * *